US010823171B2

(12) United States Patent
Diao et al.

(10) Patent No.: US 10,823,171 B2
(45) Date of Patent: Nov. 3, 2020

(54) SCROLL COMPRESSOR WITH BAFFLES AND OIL DISPERSING DEVICE

(71) Applicant: Gree Electric Appliances, Inc. of Zhuhai, Guangdong (CN)

(72) Inventors: Jian Diao, Zhuhai (CN); Qiuhe Guo, Zhuhai (CN); Yusheng Hu, Zhuhai (CN); Zhenwen Cao, Zhuhai (CN); Xiaolei Li, Zhuhai (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 280 days.

(21) Appl. No.: 15/778,137

(22) PCT Filed: Sep. 21, 2016

(86) PCT No.: PCT/CN2016/099521

§ 371 (c)(1),
(2) Date: May 22, 2018

(87) PCT Pub. No.: WO2017/088570

PCT Pub. Date: Jun. 1, 2017

(65) Prior Publication Data

US 2018/0355868 A1 Dec. 13, 2018

(30) Foreign Application Priority Data

Nov. 23, 2015 (CN) ..... 2015 1 0822932

(51) Int. Cl.
*F04C 18/02* (2006.01)
*F04C 23/00* (2006.01)
(Continued)

(52) U.S. Cl.
CPC ..... *F04C 18/0215* (2013.01); *F04C 2/025* (2013.01); *F04C 23/008* (2013.01); *F04C 29/026* (2013.01); *F04C 29/028* (2013.01)

(58) Field of Classification Search
CPC .... F04C 29/028; F04C 2/025; F04C 18/0215; F04C 2240/30; F04C 29/12
See application file for complete search history.

(56) References Cited

U.S. PATENT DOCUMENTS 6,402,485 B2 * 6/2002 Hong ..... F04C 23/008 417/366
7,204,680 B2 * 4/2007 Park ..... F04C 18/0215 418/55.1
(Continued)

FOREIGN PATENT DOCUMENTS

CN 1174594 2/1998
CN 2758531 2/2006
(Continued)

*Primary Examiner* — Mary Davis
(74) *Attorney, Agent, or Firm* — Brandon V. Zuniga; James R. Gourley; Carstens & Cahoon, LLP

(57) ABSTRACT

Disclosed is a scroll compressor comprising a housing; a crankshaft rotor assembly and a stator assembly which are disposed inside the housing; a frame, which is provided inside the housing and corresponds to the refrigerant inlet, the frame dividing the interior cavity of the housing into an independent upper cavity and an independent lower cavity; a first baffle component is arranged on the frame at a position corresponding to the refrigerant inlet; a second baffle component extends through the frame and connects the upper cavity to the lower cavity; the frame is provided with an oil guide hole; an oil dispersing device is arranged at an outlet of the oil guide hole to disperse oil. Also provided is an electrical product comprising the scroll compressor.

18 Claims, 5 Drawing Sheets

(51) Int. Cl.
*F04C 29/02* (2006.01)
*F04C 2/02* (2006.01)

(56) References Cited

U.S. PATENT DOCUMENTS

| | | | | |
|---|---|---|---|---|
| 8,152,503 | B2 * | 4/2012 | Haller | F04C 18/0215 418/151 |
| 2008/0175738 | A1 * | 7/2008 | Jung | F04C 18/0215 418/55.6 |

FOREIGN PATENT DOCUMENTS

| | | |
|---|---|---|
| CN | 105332913 | 2/2016 |
| CN | 205135995 | 4/2016 |
| JP | 2001207980 | 8/2001 |

* cited by examiner

SCROLL COMPRESSOR WITH BAFFLES AND OIL DISPERSING DEVICE

CROSS REFERENCE TO RELATED APPLICATIONS

This application is a continuation application of PCT Patent Application No. PCT/CN2016/099521, entitled "Scroll Compressor and Electrical Product Comprising Same", filed on Sep. 21, 2016, which claims priority to Chinese Patent Application No. 201510822932.9, entitled "Scroll Compressor and Electrical Product Comprising Same", filed on Nov. 23, 2015, the entire contents of which are incorporated herein by reference.

TECHNICAL FIELD

The present invention relates to the technical field of compressors, and more particularly, to a scroll compressor and an electrical product comprising the same.

BACKGROUND

The scroll compressor mainly comprises a housing, a compressing mechanism, a supporting mechanism, a driving mechanism, a working fluid suction pipe, and a working fluid discharge pipe. The compressing mechanism comprises an orbiting scroll member and a fixed scroll member. The driving mechanism includes a stator assembly and a crankshaft rotor assembly. The crankshaft of the crankshaft rotor assembly drives the orbiting scroll member. The orbiting scroll member is provided with a rotation prevention mechanism, so the orbiting scroll member can move translationally relative to the fixed scroll member under the driving of the crankshaft. The volume of the compression chamber confined by the spiral wrap of the fixed scroll member and the spiral wrap of the orbiting scroll member becomes smaller gradually, and the refrigerant pressure therein increases continuously, thereby the refrigerant, which is drawn into the compression chamber through the working fluid suction pipe, is compressed and then discharged from the discharge port disposed at the center of the scroll member, and through the working fluid discharge pipe, the refrigerant is discharged from the compressor to the external circulation circuit. In this way, the working cycle of sucking, compressing and discharging the refrigerant is realized.

There are two kinds of gas refrigerant flow directions of the in the existing scroll compressor:

First, the refrigerant flows into the housing through the working fluid suction pipe, and is deflected by the baffle device to change the refrigerant from flowing in a radial direction to flow downwards in an axial direction.

Second, through the working fluid suction pipe, the refrigerant flows into the housing and diffuses freely.

In both flow directions, before flowing into the compressing mechanism, the refrigerant fluid is heated by the stator assembly of the driving mechanism, which will result in an overheating of the suction gas, thereby reducing the volumetric efficiency and increasing discharge temperature. In the situation that the scroll compressor uses R32 refrigerant or other refrigerants with characteristics of high discharge temperature, both flow directions above will have bad effects on the efficiency and reliability of the compressor.

SUMMARY OF THE INVENTION

The present invention provides a scroll compressor, after the refrigerant flows into the housing of the scroll compressor through the refrigerant inlet, most refrigerant flows into the suction port of the fixed scroll member, and other refrigerant cools the stator assembly of the driving mechanism, which solves the problem of an increased discharge temperature due to the suction gas of the scroll compressor that is preheated by the stator assembly of the driving mechanism. The embodiment of the present disclosure also provides an electrical product comprising the scroll compressor described above.

The scroll compressor provided by the present invention comprises:

a housing, which is provided with a refrigerant inlet configured to suck refrigerant into interior of the housing;

a crankshaft rotor assembly and a stator assembly which are disposed inside the housing, wherein, the crankshaft rotor assembly includes a crankshaft comprising a centering shaft member and an eccentric shaft member;

an orbiting scroll member driven by the eccentric shaft member of the crankshaft;

a fixed scroll member, which forms a compression chamber together with the orbiting scroll member;

a frame, which is provided inside the housing and corresponds to the refrigerant inlet; wherein, a side wall of the frame is fixedly connected with an inner wall of the housing; the frame divides the interior cavity of the housing into an independent upper cavity and an independent lower cavity; the frame is idly sleeved on the centering shaft member; a first baffle component, which is configured to guide refrigerant to flow into the upper cavity, is arranged on the frame at a position corresponding to the refrigerant inlet; a second baffle component extends through the frame and connects the upper cavity to the lower cavity; the frame is provided with an oil reservoir and an oil guide hole for guiding oil in the oil reservoir to an upper end surface of the frame; an oil dispersing device, which is configured to disperse oil guided from the oil guide hole, is arranged at an outlet of the oil guide hole.

Preferably, the oil dispersing device is a slider, which is arranged on a lower end surface of the orbiting scroll member and moves along with the orbiting scroll member; the slider slidingly fits with the upper end surface of the frame; and a movement trajectory of the slider passes through the outlet of the oil guide hole.

Preferably, the first baffle component and the second baffle component are respectively arranged at two opposite positions on the frame.

Preferably, the first baffle component is a guiding groove disposed on a side wall of the frame; edges of a longitudinal section of the guiding groove are L-shaped; and a side surface of the L-shaped guiding groove is convex arc surface towards a center of the frame.

Preferably, a width of the guiding groove is equal to or larger than a diameter of the refrigerant inlet.

Preferably, a center of the side surface of the guiding groove is aligned with a central axis of the refrigerant inlet.

Preferably, a top of the guiding groove is flush with a bottom surface of a suction port of the fixed scroll member.

Preferably, a sink is disposed at a bottom of the guiding groove; two side walls of the sink are arc-shaped; and an arc-shaped deflector is arranged and inserted in the sink.

Preferably, a radius of an inner side surface of the deflector is greater than a radius of an inner side wall of the sink; and a radius of an outer side surface of the deflector is smaller than a radius of an outer side wall of the sink.

Preferably, a center of the deflector is aligned with a central axis of the refrigerant inlet; and a flare angle of the deflector is smaller than a flare angle of the sink, and is equal to or greater than a half of the flare angle of the sink.

Preferably, a top of the deflector is flush with a bottom surface of a suction port of the fixed scroll member.

The present invention further provides an electrical product, comprising a compressor, which is any one of the scroll compressor defined above.

The scroll compressor provided by the present invention comprises:

a housing, which is provided with a refrigerant inlet configured to suck refrigerant into interior of the housing;

a crankshaft rotor assembly and a stator assembly which are disposed inside the housing, wherein, the crankshaft rotor assembly includes a crankshaft comprising a centering shaft member and an eccentric shaft member;

an orbiting scroll member driven by the eccentric shaft member of the crankshaft;

a fixed scroll member, which forms the compression chamber together with the orbiting scroll member;

a frame, which is provided inside the housing and corresponds to the refrigerant inlet; wherein, a side wall of the frame is fixedly connected with an inner wall of the housing; the frame divides the interior cavity of the housing into an independent upper cavity and an independent lower cavity; the frame is idly sleeved on the centering shaft member; a first baffle component, which is configured to guide refrigerant to flow into the upper cavity, is arranged on the frame at a position corresponding to the refrigerant inlet; a second baffle component extends through the frame and connects the upper cavity to the lower cavity; the frame is provided with an oil reservoir and an oil guide hole for guiding oil in the oil reservoir to an upper end surface of the frame; an oil dispersing device, which is configured to disperse oil guided from the oil guide hole, is arranged at an outlet of the oil guide hole.

In the scroll compressor provided by the present invention, the refrigerant flows into the interior of the housing through the refrigerant inlet, then is deflected by the first baffle component to flow into and disperse freely inside the upper cavity of the housing over the frame. At the same time, the oil flows out of the oil reservoir through the oil guide hole, and the oil dispersing device disperses the oil from the oil guide hole to form oil drops. After fully contacting with the refrigerant in the upper cavity, part of the mixture of the oil drops and the refrigerant flows into the compression chamber formed by the orbiting scroll member and the fixed scroll member; the other part of the mixture of the oil drops and the refrigerant, after being deflected by the second baffle component, flows into the lower cavity under the frame to cool the driving motor. Therefore, without affecting the cooling of the motor, the scroll compressor ensures the oil content of the suction gas, reduces the overheating of the suction gas and reduces the discharge temperature.

BRIEF DESCRIPTION OF THE DRAWINGS

In order to describe the embodiments of the present disclosure or the technical schemes of the prior art more clearly, the present disclosure will be described briefly with reference to the figures used in describing the embodiments or the prior art. The figures described hereafter are merely some embodiments to explain the present invention. For those skilled in the art, other figures can be obtained according to the figures provided hereafter without any creative work.

In FIGS. 1 to 5:

Figure 1:
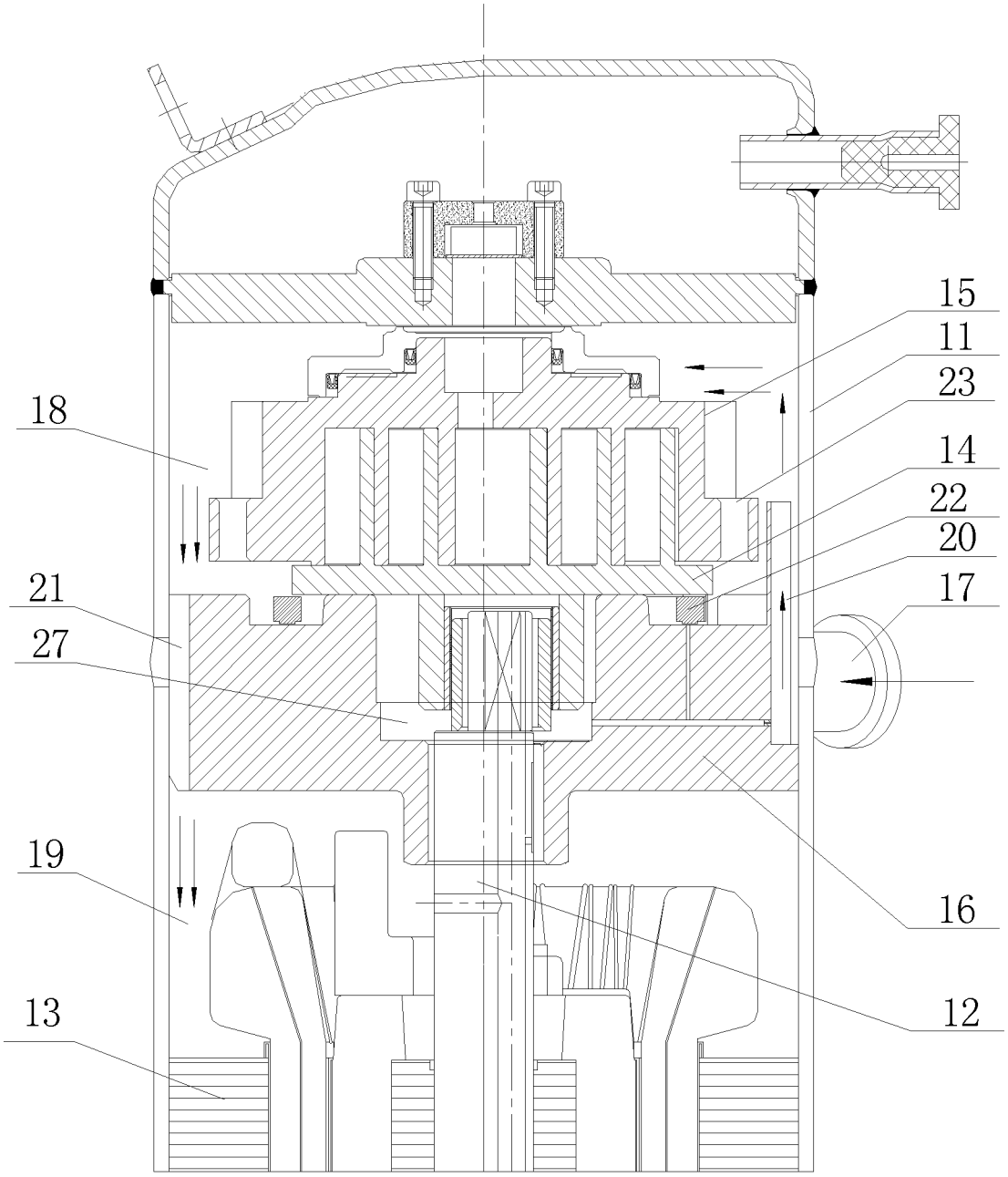
FIG. 1 is a schematic internal view of the compressor according to the first embodiment of the present invention.

housing—11, crankshaft rotor assembly—12, stator assembly–13, orbiting scroll member—14, fixed scroll member—15, frame—16, refrigerant inlet—17, upper cavity—18, lower cavity—19, first baffle component—20, second baffle component—21, slider—22, suction port of the fixed scroll member—23, radial oil passage—24, axial oil passage—25, rubber plug—26, oil reservoir—27, sink—28, deflector—29, side surface of guiding groove—30.

DETAILED DESCRIPTION OF THE PREFERRED EMBODIMENTS

The embodiment of the present disclosure provides a scroll compressor. After the refrigerant flows into the housing of the scroll compressor through the refrigerant inlet, most refrigerant flows into the suction port of the fixed scroll member, and other refrigerant cools the stator assembly of the driving mechanism, which solves the problem of an increased discharge temperature due to the suction gas of the scroll compressor that is preheated by the stator assembly of the driving mechanism. The embodiment of the present disclosure also provides an electrical product comprising the scroll compressor described above.

The technical schemes of the embodiments of the present invention will be described clearly and in more details with reference to the accompanying figures in the embodiments of the present invention. Obviously, what described below are several but not all embodiments of the present invention. For those skilled in the art, other embodiments obtained based on the embodiments of the present disclosure without creative work are within the scope of the present invention.

As shown in FIGS. 1-5, the scroll compressor of the present embodiment includes a housing 11, a crankshaft rotor assembly 12, a stator assembly 13, an orbiting scroll member 14, a fixed scroll member 15 and a frame 16.

Wherein, the housing 11 is provided with a refrigerant inlet 17 configured to suck refrigerant into the interior of the housing 11. The crankshaft rotor assembly 12 and the stator assembly 13 are disposed inside the housing 11. It should be noted that, the crankshaft rotor assembly 12 includes a rotor and a crankshaft; the rotor and the stator assembly 13 form a driving motor to drive the crankshaft to rotate. The crankshaft includes a centering shaft member and an eccentric shaft member. The rotation axis of the centering shaft member is coaxially with its own axis, while the rotation axis of the centering shaft member deflects from its own axis. The centering shaft member drives the eccentric shaft member to rotate, thereby driving the orbiting scroll member 14 to move translationally. Since the orbiting scroll member 14 and the fixed scroll member 15 form the compression chamber, and the fixed scroll member 15 is provided with a suction hole, after the refrigerant enters the compression chamber through the suction hole, the translational movement of the orbiting scroll member 14 causes the volume of the compression chamber to change, thereby compressing the refrigerant.

The frame 16 is provided inside the housing 11 and corresponds to the refrigerant inlet 17. The side wall of the frame 16 is fixedly connected with the inner wall of the housing 11. The frame 16 divides the interior cavity of the housing 11 into an upper cavity 18 and a lower cavity 19 which are independent, and the frame 16 is idly sleeved on the centering shaft member, namely, the frame 16 will not be driven by the centering shaft member to rotate.

A first baffle component 20, which is configured to guide the refrigerant to flow into the upper cavity 18, is arranged on the frame 16 at a position corresponding to the refrigerant inlet 17. A second baffle component 21 is configured to extend through the frame 16 and to connect the upper cavity 18 to the lower cavity 19. The frame 16 is provided with an oil reservoir 27 and an oil guide hole for guiding the oil in the oil reservoir 27 to the upper end surface of the frame 16. An oil dispersing device for dispersing oil guided from the oil guide hole is arranged at the outlet of the oil guide hole.

In the scroll compressor provided by the present invention, the refrigerant flows into the interior of the housing 11 through the refrigerant inlet 17, then is deflected by the first baffle component 20 to flow into and disperse freely inside the upper cavity 18 of the housing 11 over the frame 16. At the same time, the oil flows out of the oil reservoir 27 through the oil guide hole, and the oil dispersing device disperses the oil from the oil guide hole to form oil drops. After fully contacting with the refrigerant in the upper cavity 18, part of the mixture of the oil drops and the refrigerant flows into the compression chamber formed by the orbiting scroll member 14 and the fixed scroll member 15; the other part of the mixture of the oil drops and the refrigerant, after being deflected by the second baffle component 21, flows into the lower cavity 19 under the frame 16 to cool the driving motor. Therefore, without affecting the cooling of the motor, the scroll compressor ensures the oil content of the suction gas, reduces the overheating of the suction gas and reduces the discharge temperature.

It should be noted that, the above-mentioned oil dispersing device for dispersing oil into oil drops may be specifically configured as follows: the oil dispersing device may be a slider 22, which is arranged on the lower end surface of the orbiting scroll member 14 and moves along with the orbiting scroll member 14. Namely, the slider 22 is driven by the orbiting scroll member 14 to slide circularly on the upper end surface of the frame 16. What's more, the movement trajectory of the slider 22 passes through the outlet of the oil guide hole. After the oil spurts out the oil guide hole, the slider 22 passes through the outlet of the oil guide hole, dispersing the oil into oil drops.

In order to disperse the oil completely, the slider 22 described above may be configured be an Oldham ring. Of course, the slider 22 may have any other structure that can disperse the oil completely.

Figure 2:
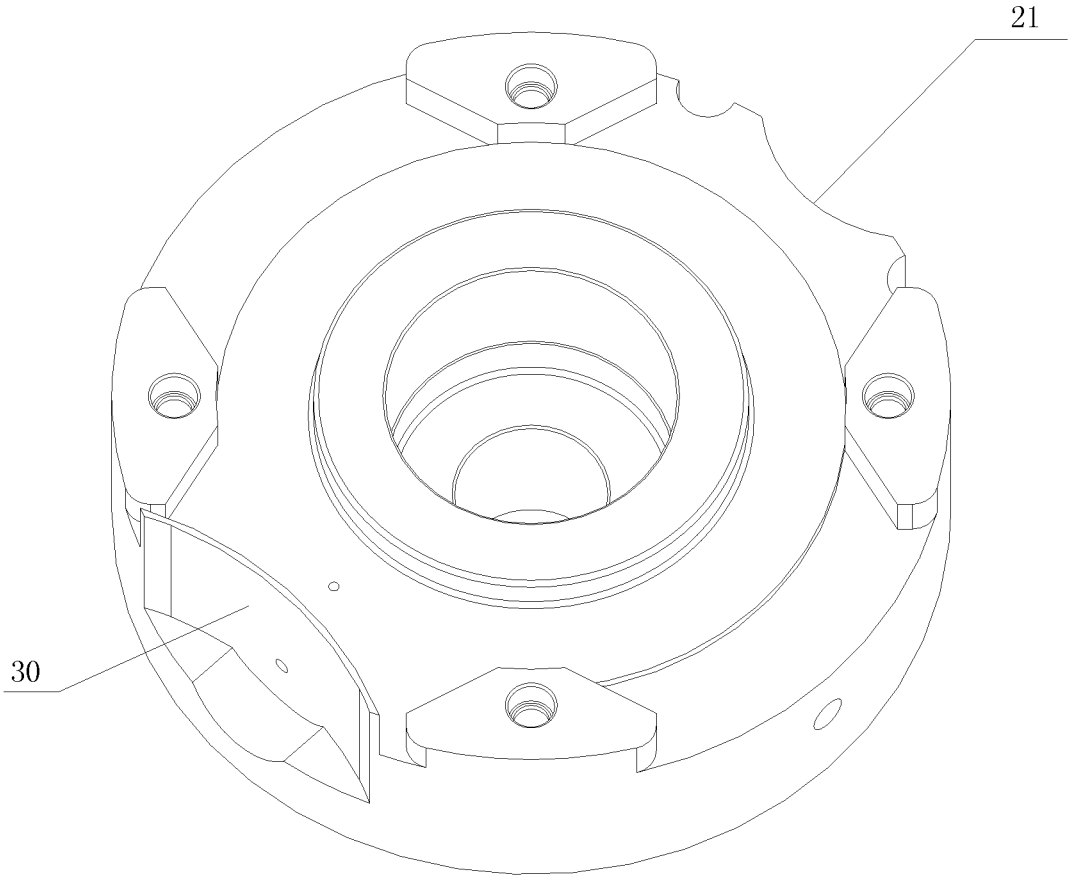
FIG. 2 is a schematic perspective view of the frame according to the first embodiment of the present invention.
Figure 3:
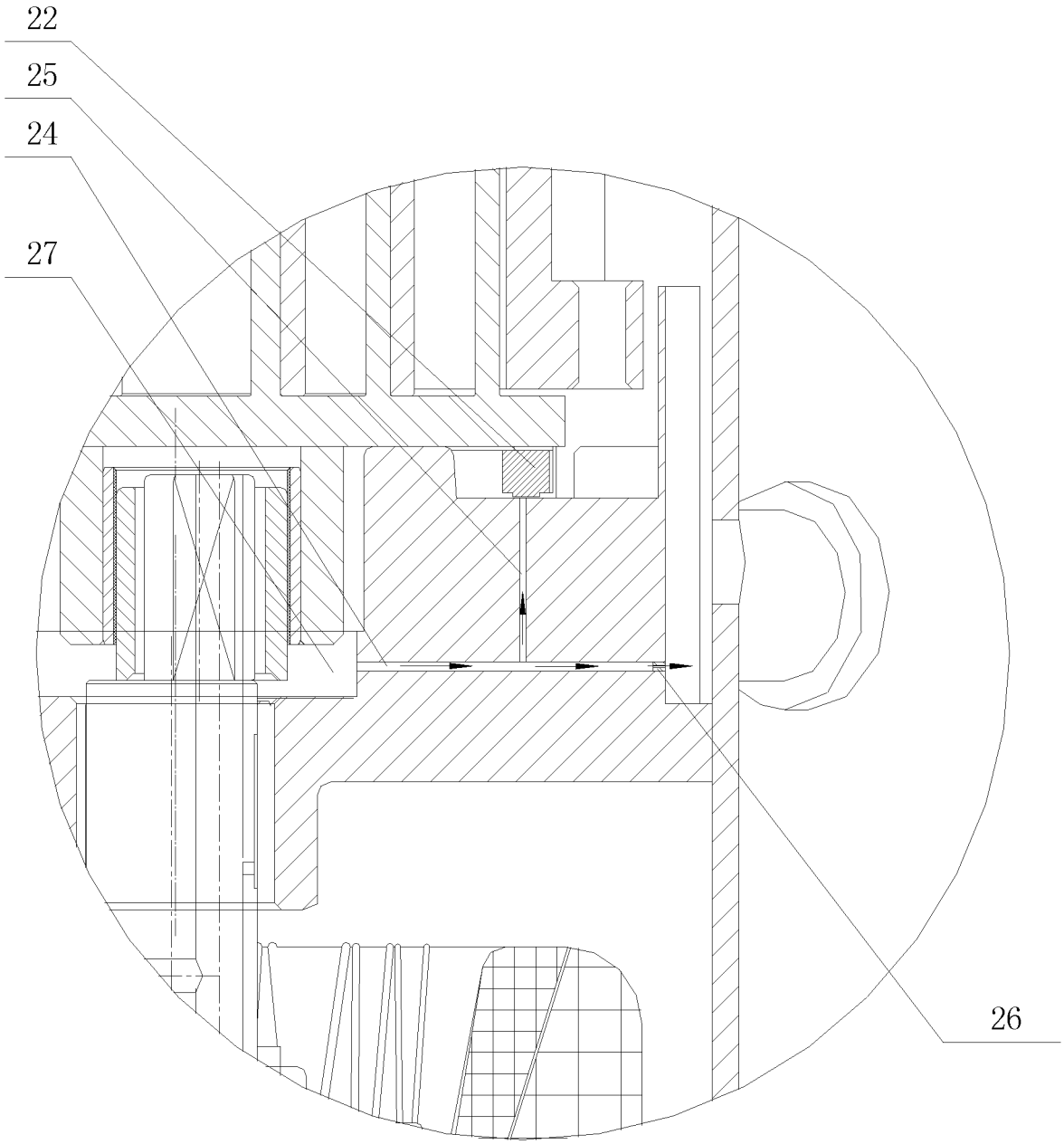
FIG. 3 is a partial cross-sectional view of the compressor according to the first embodiment of the present invention.

The present invention will be described in details combining two specific embodiments. As shown in FIG. 2 and FIG. 3, the frame 16 and the housing 11 are in an interference fit, and a guiding groove is disposed on a side wall of the frame 16, which corresponds to the refrigerant inlet 17 in the housing 11. The edges of a longitudinal section of the guiding groove are L-shaped. The L-shaped guiding groove forms the first baffle component 20. It should be noted that in order to ensure good effects of deflecting, the side surface 30 of the L-shaped guiding groove is convex arc surface towards the center of the frame 16.

In addition, the L-shaped guiding groove must not be arranged to interfere with the movement of the Oldham ring. In order to ensure good effects of deflecting, the center of the side surface of the L-shaped guiding groove should be as far as possible aligned with the axis of the refrigerant inlet 17, what's more, the span length of the L-shaped guiding groove is larger than the diameter of the refrigerant inlet 17. Preferably, the top of the L-shaped guiding groove is as far as possible flush with the bottom surface of the suction port 23 of the fixed scroll member, which is more favorable for the compression chamber formed by the orbiting scroll member 14 and the fixed scroll member 15 to suck gas freely.

A second baffle component 21 is disposed at the opposite side of the frame 16, which is opposite to the side where the refrigerant inlet 17 is disposed. The second baffle component 21 may be several passages axially extending through the frame 16 and formed by cutting partial edges of the frame 16, or may be several round holes axially extending through the frame 16. Preferably, the second baffle component 21 is disposed at the opposite side of the frame 16, which is exactly opposite to the side where the refrigerant inlet 17 is disposed, thereby enabling the compression chamber formed by the orbiting scroll member 14 and the fixed scroll member 15 to suck gas and discharge completely.

In addition, a radial oil passage 24 and an axial oil passage 25 are disposed in the frame 16. A rubber plug 26 is arranged at the joint of the radial oil passage 24 and the L-shaped guiding groove. Preferably, the outlet of the axial oil passage 25 faces exactly the Oldham ring. The lubricating oil flows from the oil reservoir 27 of the frame 16 into the radial oil passage 24, and then into the axial oil passage 25, and finally is dispersed into small oil droplets by the Oldham ring and contact with the suction gas completely, thereby increasing the oil content of the suction gas.

The refrigerant flows into the interior of the housing 11 through the refrigerant inlet 17; after being deflected by the L-shaped guiding groove on the frame 16, the refrigerant flows into and disperses freely in the upper cavity over the frame 16. At the same time, the oil flows from the oil reservoir 27 into the radial oil passage 24 and the axial oil passage 25, then is dispersed into oil droplets by the Oldham ring and contacts with the refrigerant completely; part of the mixture of the oil and the refrigerant is sucked into the compression chamber formed by the orbiting scroll member 14 and the fixed scroll member 15 and other part of the mixture of the oil and the refrigerant flows into the lower cavity of the frame 16, to cool the driving motor. Therefore, without affecting the cooling of the motor, the scroll compressor ensures the oil content of the suction gas, reduces the overheating of the suction gas and reduces the discharge temperature.

Figure 4:
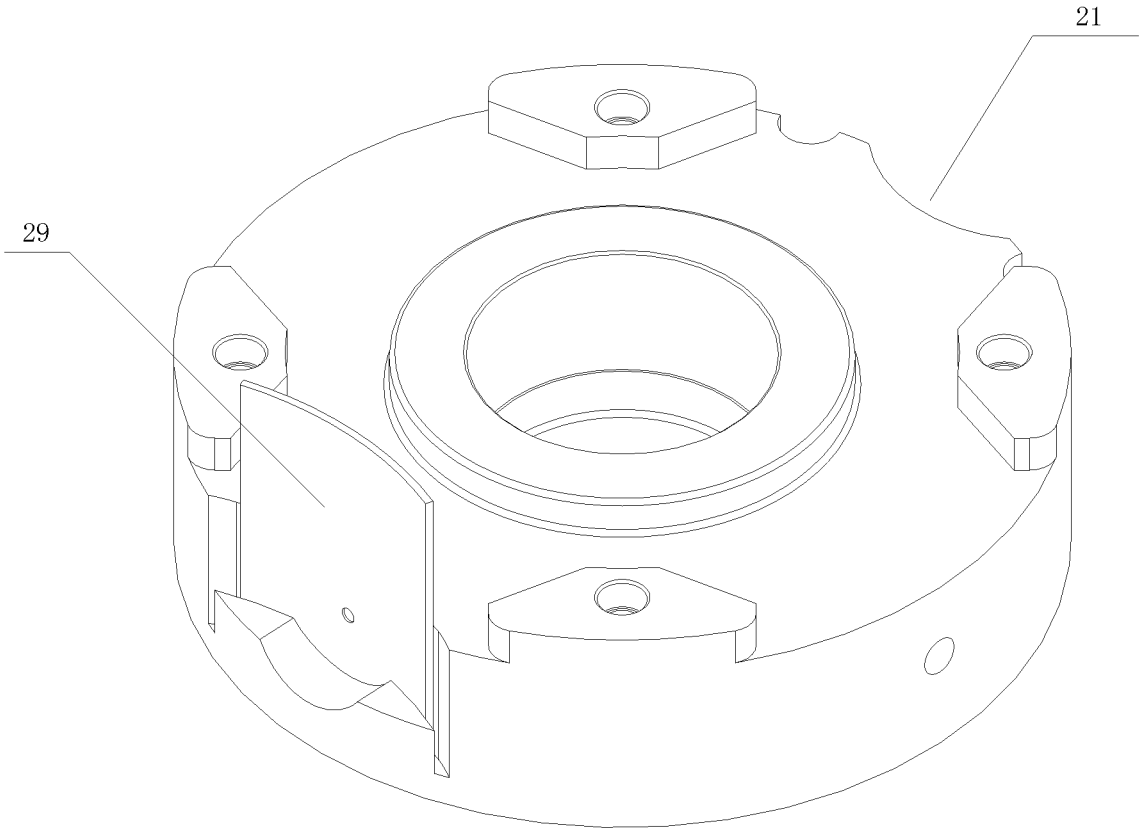
FIG. 4 is a schematic perspective view of the frame according to the second embodiment of the present invention.
Figure 5:
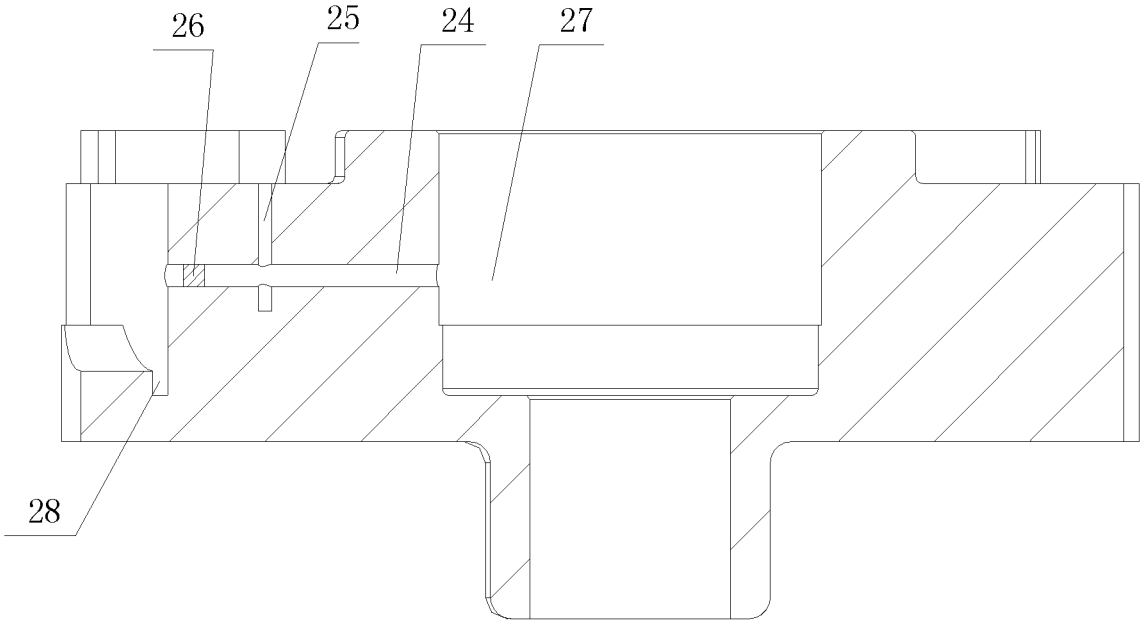
FIG. 5 is a cross-sectional view of the frame without a deflector according to the second embodiment of the present invention.

In the second embodiment of the present invention, the first baffle component 20 may be specifically constructed as follows: as shown in FIG. 4 and FIG. 5, a sink 28 is disposed at the bottom of the L-shaped guiding groove; two side walls of the sink 28 are arc-shaped, and an arc-shaped deflector 29 is arranged and inserted in the sink 28.

For simplifying the process of processing and assembly, two ends of the sink groove 28 intersects the outer circle surface of the frame 16, and the distance between the two intersections should be greater than the outer diameter of the refrigerant inlet 17. The deflector 29 matches with the sink 28. The radius of the inner side surface of the deflector 29 should be greater than the radius of the inner side wall of the sink 28, and the radius of the outer side surface of the deflector 29 should be smaller than the radius of the outer side wall of the sink 28.

In order to ensure good effects of deflecting, the axial center plane of the deflector 29 should be aligned with the central axis of the refrigerant inlet 17 as much as possible, and the flare angle of the deflector 29 should be smaller than the flare angle of the sink 28, but cannot be less than a half of the flare angle of the sink 28. After the deflector 29 is placed in the sink 28, the top of the deflector 29 is as flush as possible with the bottom surface of the suction port 23 of the fixed scroll member, which is more favorable for the compression chamber formed by the orbiting scroll member 14 and the fixed scroll member 15 to suck gas freely. In this way, the first baffle component 20 of this embodiment has better deflecting effects.

The embodiment of this disclosure also provides an electrical product comprising a compressor, which is the scroll compressor described in the embodiments above. It should be noted that, the electrical product provided by the present embodiment may be a refrigerator, an air conditioner, or a hot water unit, etc. The electrical product provided by the present embodiment solves the problem of an increased discharge temperature due to the suction gas of the scroll compressor that is preheated by the stator assembly 13 of a driving mechanism. The derivation process of the beneficial effects brought by the electrical product is substantially similar to that of the beneficial effects brought by the scroll compressor above, so it will not be repeated herein.

The description of the embodiments disclosed above enables those skilled in the art to implement or use the present invention. Various modifications to these embodiments are readily apparent to those skilled in the art, and the general principles defined herein may be applied to other embodiments without departing from the spirit or scope of the invention. Thus, the present invention will not be limited to the embodiments shown herein but will conform to the widest scope consistent with the principles and novel features disclosed herein.

What is claimed is:

1. A scroll compressor, comprising:

a housing, which is provided with a refrigerant inlet configured to suck refrigerant into an interior of the housing;

a crankshaft rotor assembly and a stator assembly which are disposed inside the housing, wherein, the crankshaft rotor assembly includes a crankshaft comprising a centering shaft member and an eccentric shaft member;

an orbiting scroll member driven by the eccentric shaft member of the crankshaft;

a fixed scroll member, which forms a compression chamber together with the orbiting scroll member;

a frame, which is provided inside the housing and corresponds to the refrigerant inlet, wherein (i) a side wall of the frame is fixedly connected with an inner wall of the housing, (ii) the frame divides the interior cavity of the housing into an independent upper cavity and an independent lower cavity, (iii) the frame is idly sleeved on the centering shaft member, and (iv) the frame is provided with an oil reservoir and an oil guide hole for guiding oil in the oil reservoir to an upper end surface of the frame;

a first baffle component, which (i) is configured to guide refrigerant to flow into the upper cavity and (ii) is arranged on the frame at a position corresponding to the refrigerant inlet;

a second baffle component, which extends through the frame and connects the upper cavity to the lower cavity, the first baffle component and the second baffle component being respectively arranged at two opposite positions on the frame; and an oil dispersing device, which (i) is configured to disperse oil guided from the oil guide hole and (ii) is arranged at an outlet of the oil guide hole.

2. The scroll compressor of claim 1, wherein, the oil dispersing device is a slider, which is arranged on a lower end surface of the orbiting scroll member and moves along with the orbiting scroll member; the slider slidingly fits with the upper end surface of the frame; and a movement trajectory of the slider passes through the outlet of the oil guide hole.

3. The scroll compressor of claim 1, wherein, the first baffle component is a guiding groove disposed on a side wall of the frame; edges of a longitudinal section of the guiding groove are L-shaped; and a side surface of the L-shaped guiding groove is convex arc surface towards a center of the frame.

4. The scroll compressor of claim 3, wherein, a width of the guiding groove is equal to or larger than a diameter of the refrigerant inlet.

5. The scroll compressor of claim 3, wherein, a center of the side surface of the guiding groove is aligned with a central axis of the refrigerant inlet.

6. The scroll compressor of claim 3, wherein, a top of the guiding groove is flush with a bottom surface of a suction port of the fixed scroll member.

7. The scroll compressor of claim 3, wherein, a sink is disposed at a bottom of the guiding groove; two side walls of the sink are arc-shaped; and an arc-shaped deflector is arranged and inserted in the sink.

8. The scroll compressor of claim 7, wherein, a radius of an inner side surface of the deflector is greater than a radius of an inner side wall of the sink; and a radius of an outer side surface of the deflector is smaller than a radius of an outer side wall of the sink.

9. The scroll compressor of claim 8, wherein, a center of the deflector is aligned with a central axis of the refrigerant inlet; and a flare angle of the deflector is smaller than a flare angle of the sink, and is equal to or greater than a half of the flare angle of the sink.

10. The scroll compressor of claim 9, wherein, a top of the deflector is flush with a bottom surface of a suction port of the fixed scroll member.

11. An electrical product, characterized by comprising a compressor, which is the scroll compressor defined in claim 1.

12. The electrical product of claim 1, wherein, the oil dispersing device is a slider, which is arranged on a lower end surface of the orbiting scroll member and moves along with the orbiting scroll member; the slider slidingly fits with the upper end surface of the frame; and a movement trajectory of the slider passes through the outlet of the oil guide hole.

13. The electrical product of claim 11, wherein, the first baffle component is a guiding groove disposed on a side wall of the frame; edges of a longitudinal section of the guiding groove are L-shaped; and a side surface of the L-shaped guiding groove is convex arc surface towards a center of the frame.

14. The electrical product of claim 13, wherein, a width of the guiding groove is equal to or larger than a diameter of the refrigerant inlet.

15. The electrical product of claim 13, wherein, a center of the side surface of the guiding groove is aligned with a central axis of the refrigerant inlet.

16. The electrical product of claim 13, wherein, a top of the guiding groove is flush with a bottom surface of a suction port of the fixed scroll member.

17. The electrical product of claim 13, wherein, a sink is disposed at a bottom of the guiding groove; two side walls of the sink are arc-shaped; and an arc-shaped deflector is arranged and inserted in the sink.

18. The electrical product of claim 17, wherein, a radius of an inner side surface of the deflector is greater than a radius of an inner side wall of the sink; and a radius of an outer side surface of the deflector is smaller than a radius of an outer side wall of the sink.

* * * * *